United States Patent [19]

Dee

[11] 4,143,830

[45] Mar. 13, 1979

[54] CORE SUPPORTS

[76] Inventor: Anthony N. Dee, Kenwood Lee, Sheldon Ave., Highgate, London N.6, England

[21] Appl. No.: 855,349

[22] Filed: Nov. 28, 1977

[30] Foreign Application Priority Data

Dec. 4, 1976 [GB] United Kingdom ..... 50661/76

[51] Int. Cl.[2] ..... B65H 75/18

[52] U.S. Cl. ..... 242/72 R

[58] Field of Search ..... 242/72 R, 46.4, 56.9, 242/68.2; 279/1 DC, 2 R, 2 A

[56] References Cited

U.S. PATENT DOCUMENTS

| | | | |
|---|---|---|---|
| 2,161,061 | 6/1939 | Keyes | 242/72 |
| 2,238,460 | 4/1941 | Bruestle | 242/72 |
| 2,561,745 | 7/1951 | Lerch | 242/72 |
| 3,006,565 | 10/1961 | Pelletier | 242/72 X |
| 4,026,488 | 5/1977 | Hashimoto | 242/72 B |

FOREIGN PATENT DOCUMENTS

| | | | |
|---|---|---|---|
| 697837 | 10/1940 | Fed. Rep. of Germany | 242/72 |

*Primary Examiner*—Edward J. McCarthy
*Attorney, Agent, or Firm*—Rudolph J. Jurick

[57] ABSTRACT

A core supporting device has mounting means for core locking elements, preferably roller members, which allow unrestrained radial movement of the locking elements during constrained circumferential movement thereof. The mounting means is preferably a sleeve having apertures through which the locking elements protrude.

9 Claims, 3 Drawing Figures

CORE SUPPORTS

BACKGROUND OF THE INVENTION

This invention relates to devices for supporting cores particularly for use in mandrels for use in slitter/-rewinding machines.

In slitter/rewinding machines a wide web is unwound from a feed roll of web material and passes through suitable slitter knives or slitter rollers in which the wide web is divided into a plurality of parallel narrow webs. Usually, alternate narrow webs are guided into rewind cores located in spaced apart relationship on one of two parallel rewind mandrels. In the differential centre winder system the mandrel is rotated to provide a power source for the rewind action and the cores are freely rotatable on the mandrel and connectable to it by slip clutch means which can comprise, for example, a disc keyed to the mandrel and rotating with it and a felt washer having one radial face in contact with the disc and another radial face in contact with a corresponding surface on the core or on a support member for the core. Spring means urge the various members towards each other to provide for the transmission of a torque. In this way each individual core has its own individual slip clutch drive from the mandrel.

Because of problems with the surface finish on the radial end surfaces of cores it has become the practice to use core supports which are manufactured to close engineering limits and transmit the torque from the mandrel and the slip clutch to the cores mounted on the supports.

Certain of these core supports suffer from the disadvantage that in order to remove the loaded cores from the mandrel it is necessary to remove all the clutch and core support parts from the mandrel during the removal operation to remove the loaded cores. This often entails the removal of the entire mandrel from the slitter/-rewinding machine.

Core supports have been made which are designed to overcome the above mentioned disadvantage but such core supports are complicated and either may make it difficult to pass loaded cores over the core supports and clutch parts for removal from one end of the mandrel or may include spring loaded elements which can impare locking of a core onto the core support. One prior art device is shown in U.K. Pat. No. 1416320.

SUMMARY OF THE INVENTION

According to the present invention there is provided a device for supporting a core on a shaft comprising an annular base member provided with a radially inner surface for mounting the device on a shaft, cam surface means fixed with respect to and directed radially of the base member and extending circumferentially thereof, at least one locking element, and means mounting the or each locking element in said device for unrestrained movement thereof radially between first and second radial positions and for constrained movement thereof circumferentially relative to the cam surface means, during said constrained movement the or each locking element being arranged to cooperate with said cam surface means for movement into said second radial position, and wherein the device presents a substantially cylindrical radially outer envelope, in said first radial position the or each locking element lying substantially wholly radially within said envelope and, in said second radial position, a significant portion of the or each locking element lying outside said envelope.

In use of the device according to the invention, it may be left on a mandrel and, for loading of empty cores, the or each roller member is, or is readily moved by the empty core so as to be located in its first radial position so that the core may be passed easily over the core supports. The cores have an internal cylindrical surface which lies outside the aforementioned envelope. When the cores are in position over their respective devices according to the invention the cores are rotated and by reason of frictional contact between the cores and the devices the or each roller member is easily moved to its second radial position in which it extends into holding contact with the radially inner surface of the core so that torque may be transferred from the device to the core.

The or each locking element may be a roller member of spherical or cylindrical form. Where it or they are of cylindrical form, it or they are preferably provided with inwardly tapered or bevelled ends to assist the passage of the core members over the or each roller member when it or they are in their first radial positions. Preferably, there are three roller members to locate the core coaxially with the mandrel.

Preferably, the mounting means is movable circumferentially with respect to the base member and is provided with a radially extending aperture for the or each locking element, each locking element being located in an associated aperture and passable radially outwardly through its associated aperture but having a dimension larger than a corresponding dimension of its associated aperture whereby to limit its radially outward movement.

In a preferred construction of the devices according to the invention there is provided mounting means in the form of a sleeve member surrounding the cam surface means lying within the envelope. Roller members are retained on the device by the sleeve but are able to pass radially through respective apertures in the sleeve in said unrestrained movement between said first and second radial positions. Furthermore relative rotation of the sleeve and the base member causes the roller members into said constrained circumferential movement and to co-operate with the cam surface means.

The invention also provides a core support mandrel comprising a shaft having a plurality of devices according to the invention fitted thereon.

Where the core is designed to receive only a narrow web a single device according to the invention may be of sufficient axial length to provide adequate support for the core. The axial length of locking elements and/or the number of locking elements extending axially on one base member may be chosen as required.

On the other hand, where a relatively wide web is to be wound on a core, it is possible to use two of the devices according to the invention located in axially spaced apart positions by a suitable spacer member. The locking elements on the individual devices then coact with portions of the core which are spaced apart along the length of the core.

The invention will now be further described by way of example only with reference to a preferred embodiment of device according to the invention and to some specific uses of this device on a slitter/rewinding machine.

BRIEF DESCRIPTION OF THE DRAWINGS

The preferred embodiment and use thereof is illustrated in the accompanying drawings in which.

DESCRIPTION OF PREFERRED EMBODIMENTS

Figure 2:
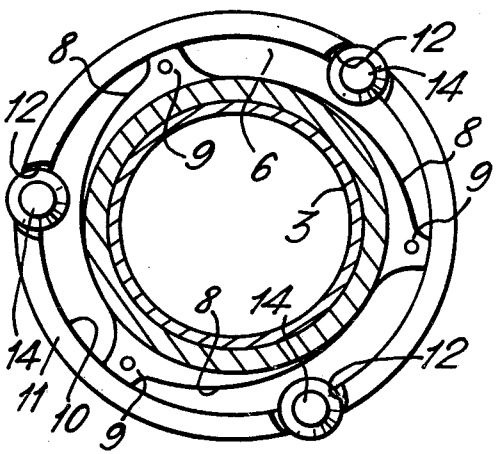
FIG. 2 is a view on line II—II of FIG. 1.

The device according to the invention in this preferred form comprises an annular base member 1 comprising a flanged body 2 having an internal bore in which is located a low friction bearing sleeve 3 by way of an interference fit. One radially extending axially outer surface 4 of the annular base member is finished to fine tolerances to provide a surface suitable for use as a clutch surface.

The radially outer surface of the base member comprises a plurality of portions of differing diameters to give a stepped configuration to the base member. The portion 5 of largest diameter is located adjacent to the aforementioned clutch surface 4 and its diameter defines the radially outer envelope of the device. Adjacent to this radially outer envelope defining portion 5 is a portion 6 of reduced diameter which forms a cylindrical support surface for a tubular sleeve 7 which will be further described below. Next to the support surface for the sleeve are provided cam surface means in the form of three cam surfaces 8. The cam surfaces 8 each extend circumferentially around the base member for slightly less than one third of the peripheral distance around the base member and have an increasing radial distance from the central axis of the base member as they proceed circumferentially around the base member. Each cam surface means is of a substantial axial width which is approximately one quarter of the circumferantial length of the corresponding cam surface. Between the three cam surfaces are located abutment portions 9 of the base member which have radially outer surfaces contiguous to the sleeve support surface of portion 6.

The sleeve 7 mounted on the base member 1 has an axial length corresponding to the combined axial length of the sleeve support surface of portion 6 and the cam surfaces 8 and a radially inner cylindrical surface 10 which allows a sliding fit over the support surfaces on the base member and a radially outer surface 11 of cylindrical form having a diameter substantially equal to that of the envelope defined by the base member 1. The sleeve has three apertures 12 therein formed as slots extending axially from one end thereof and of a length corresponding to the axial length of the cam surfaces. The remaining axial length of the outer surface 11 of the sleeve is formed as a friction generating knurled surface 13. As is clearly shown in FIG. 1 the axial length of the apertures is approximately equal to half the axial length of the sleeve 7.

Three roller members 14 are trapped one in each of the apertures 12 in the sleeve 7 by reason of the coaction of the roller members, on the one hand, with their respective cam surfaces 8 and, on the other hand, with the circumferentially spaced walls of the respective slots 12. These walls 15 have a minimum spacing slightly less than the diameter of the roller members and are provided with a curvature corresponding to the curvature of the roller members. Each roller member 14 is of a cylindrical solid form of a length slightly less than the axial length of the slots and the axial ends 16 of the roller members are bevelled to an extent that, when the roller members are forced axially out against the circumferentially spaced walls of the slot, only tapered and axially extending surfaces of the roller member protrude outside the envelope defined by the base member 1.

A final step formation is provided on the base member on the end thereof removed from the clutch surface end and is defined between the abutment members 9 and an axially extending surface of lesser diameter than the minimum diameter of the cam surface means 8. A clamping ring 17 of maximum outside diameter corresponding to that of the envelope defined by the base member is mounted on this surface and is clamped to the base member by screws 18 passing through the clamping ring and into the abutments.

Figure 3:
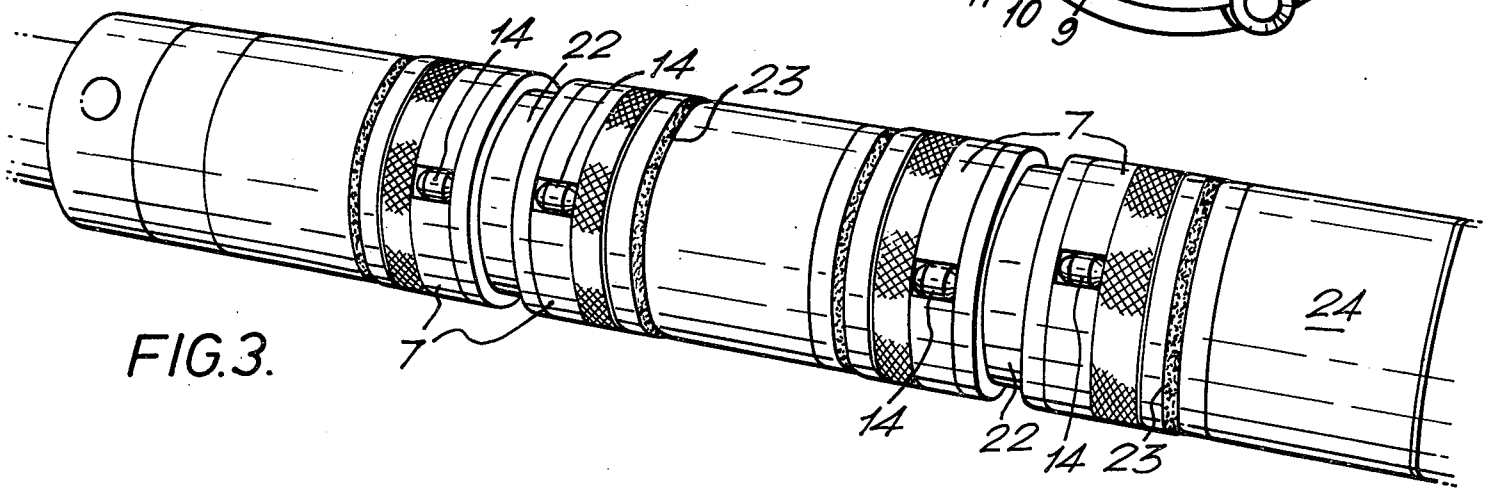
FIG. 3 is a perspective view of a mandrel supporting a plurality of the chuck of FIG. 1.

In use of the device described it is possible to mount it on the rewind mandrel shaft of a differential centre winder of a slitter/rewinding machine so that the shaft passes through the base 1 member which is freely rotatable on the mandrel (FIG. 3). The sleeve 7 is rotated relative to the base member until the slots 12 are located in positions over the portion of the respective cam surfaces 8 which are at the minimum radial distance from the central axis of the base member. In these positions when a core is passed over the device the roller members 16 can be pushed by the core within the envelope defined by the device so that the core may pass freely over the device to another part of the mandrel or be suitably located for co-operative action with respect to the device.

Such co-operative action involves rotation of the core with respect to the mandrel and the device which is held rotationally fixed by reason of the action of the clutches and spring means acting on the whole mandrel rewind assembly. Upon rotation of the core a certain frictional force generated in part by the knurled surface portion 13, is exerted on the sleeve 7, which causes this to rotate relative to the shaft and the base member 1 and to cause the roller members 14 to move circumferentially over the cam surface means 8 and to co-operate with the cam surface means to cause the roller members to move radially outwardly through the slots 12 in the sleeve and into engagement with the radially inner surface of the core. Such movement continues until the core is firmly clamped with respect to the base member so that it will not rotate further in that direction relative to the base member.

When cores have been suitably arranged along the whole length of the mandrel a narrow web may be wound on the cores by rotation of the mandrel in the opposite sense to that of the initial movement of the core with respect to the device.

When the cores fitted on the mandrel have been fully wound with tape the mandrel is stopped and swung out of the machine and about one end of the mandrel. Starting from the free end of the mandrel each loaded core is rotated relative to the mandrel in the same direction as the winding direction and by this action the roller members act on the sleeve causing this to rotate in the said direction and to allow one or more of the roller members to pass over the cam surface means and to pass radially within the slots in the sleeve and within the envelope defined by the base member. The core can now be passed freely over the base member and off the mandrel. Successive cores are released from their respective devices according to the invention in the same manner and can pass readily over the devices already freed of their cause. The bevelled ends of the roller members ensure that should one of the roller members have fallen, under the influence of gravity, outside the envelope defined by the base member the cores can readily push the roller member back within the envelope to allow ready movement of the cores over the respective device.

The devices according to the invention may be used singly or in groups of two or more to mount cores on mandrels. If the device is used singly then both the radially extending axially outer surfaces of the device are made as finished machined surfaces suitable for use as clutch surfaces in slip clutch mechanisms for transferring torque from the mandrel to the core.

Figure 1:
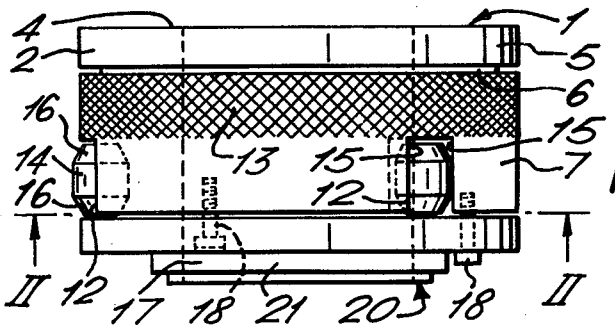
FIG. 1 is a plan view of a roll chuck.

On the other hand, if the devices are to be used in pairs, as is the case in FIG. 3, then the devices are constructed, as shown in FIG. 1, so that the axially inner facing portions 20 of the two devices of the pair are provided with axially extending surfaces 21 integral with the base member and of cylindrical form suitable for receiving a spacer member 22. In use of the pairs of devices the spacer member is preferably keyed to both the devices for rotation therewith, for example by suitable location of a screw 18 (FIG. 1), and the core is passed over the two devices when the roller members are in their radially inward positions until the core is correctly axially positioned with respect to the two devices of the pair. Rotation of the core member with respect to the two devices contrary to the winding direction of the web onto the core causes the relative rotation of the sleeves and their respective base members to cause the roller members to move radially into contact with the inside surface of the core. The axially remote outer surfaces of the two devices of the pair are both arranged as clutch surfaces for contact with a felt pad 23 of clutch means 24.

Where a particularly large core is provided it is possible to use the devices in groups of more than two. In this case the devices according to the invention which lie inwardly of the outer devices have both their axially outer faces formed as spacer support surfaces.

In use of the plurality of the devices described above on a single mandrel it is necessary to ensure that the individual devices are all constructed to the same "hand". That is, rotation of the plurality of devices in the same direction, e.g. the winding direction of the web, must result in the movement of all the roller members in the same sense, i.e. radially inwardly for the rewind direction of rotation. However, if each cam surface is arranged to have portions extending in opposite radial directions as it extends circumferentially, the device will operate for both "hands" or directions of rotation.

Thus, the devices according to the invention are of mechanically simple construction but are effective to ensure firm location of cores of virtually any width on a mandrel and to permit the removal of cores from the mandrel easily and without hindrance and without the need to remove any members of the core support or core driving devices from the mandrel. It will be apparent that the clutch means utilised must be constructed so as to lie within the radial envelope defined by the devices according to the invention.

I claim:

1. In a core supporting device, the combination of an axially extending base member, a bore extending axially through the base member for receiving a shaft, at least one radially extending flange secured to the base member and provided with a cylindrical radially outer surface, a tubular sleeve mounted on the base member for rotation relative thereto and abutting said flange and substantially axially located with respect thereto, the sleeve having a radially outer cylindrical surface substantially contiguous with the radially outer surface of the said flange, a plurality of circumferentially spaced apertures in said sleeve, each such aperture having a given axial length less than the axial length of the sleeve and a given circumferential length, a plurality of circumferentially extending cam surfaces spaced about the circumferential surface of the base member radially inwardly of said apertures, and a plurality of roller members located one in each of said apertures and in cooperative relationship with an associated one of said cam surfaces, the axial length of said roller members being not greater than the axial length of the apertures and the diameter of the roller members being greater than said given circumferential length of the apertures, whereby each roller member has unrestrained radial movement within the limits determined by contact with its associated cam surface and its associated aperture and each roller member is constrained for movement with the sleeve upon relative rotation of the sleeve and base member.

2. The combination of claim 1, wherein the apertures extend from one axial end of the sleeve for substantially half the axial length of the sleeve and a clamping ring is secured to the base member and closes the open end of the apertures.

3. The combination of claim 1, wherein the cam surfaces have an axial width which is approximately one quarter of their circumferential length.

4. The combination of claim 1, wherein the roller members are of cylindrical form and have radially inwardly tapered ends.

5. The combination of claim 1, wherein there are three said apertures circumferentially spaced equally about the device.

6. The combination of claim 1, wherein part at least of the radially outer surface of the sleeve is formed as a friction generating surface.

7. The combination of claim 1, wherein the inner surface of the bore in the base member is a cylindrical surface of a low friction bearing sleeve and a radially extending axially outer surface of the flange of the base member is a clutch surface.

8. Core supporting devices embodying the combination of claim 7 axially arranged thereon.

9. A core supporting mandrel according to claim 8, including slip clutch means co-operatively arranged between the shaft and said clutch surface of some at least of the said plurality of devices.

* * * * *